US007667663B2

(12) United States Patent
Hsiao et al.

(10) Patent No.: US 7,667,663 B2
(45) Date of Patent: Feb. 23, 2010

(54) COUPLING ANTENNA

(75) Inventors: Chih-Jen Hsiao, Hsin-Tien (TW); Po-Yuan Liao, Hsin-Tien (TW); Tsung-Wen Chiu, Hsin-Tien (TW); Fu-Ren Hsiao, Hsin-Tien (TW)

(73) Assignee: Advanced Connectek, Inc., Taipei (TW)

( * ) Notice: Subject to any disclaimer, the term of this patent is extended or adjusted under 35 U.S.C. 154(b) by 0 days.

(21) Appl. No.: 12/069,145

(22) Filed: Feb. 7, 2008

(65) Prior Publication Data

US 2008/0198089 A1 Aug. 21, 2008

(30) Foreign Application Priority Data

Feb. 15, 2007 (TW) ..... 96105853 A

(51) Int. Cl.
*H01Q 1/50* (2006.01)

(52) U.S. Cl. ..... 343/850; 343/700 MS

(58) Field of Classification Search ..... 343/700 MS, 343/846, 829, 850
See application file for complete search history.

(56) References Cited

U.S. PATENT DOCUMENTS 4,453,269 A * 6/1984 Skar ..... 455/129
4,777,490 A * 10/1988 Sharma et al. ..... 343/754
6,081,242 A 6/2000 Wingo
6,677,901 B1 * 1/2004 Nalbandian ..... 343/700 MS
7,423,598 B2 * 9/2008 Bit-Babik et al. ..... 343/702

* cited by examiner

*Primary Examiner*—Tho G Phan
(74) *Attorney, Agent, or Firm*—Schmeiser, Olsen & Watts LLP

(57) ABSTRACT

A coupling antenna has a substrate, an inducting conductor, a ground plane, a first coupling member and a second coupling member. The inducting conductor is mounted on the substrate. The ground plane is formed on and protrudes from the inducting conductor and is mounted on the substrate. The first coupling member is mounted on the substrate and is connected to a feeding cable. The second coupling member is mounted on the substrate and is connected to the first coupling member. The coupling antenna with the first coupling member, the second coupling member and the inducting conductor has a wide bandwidth and a small size.

4 Claims, 6 Drawing Sheets

COUPLING ANTENNA

BACKGROUND OF THE INVENTION

1. Field of the Invention

The present invention relates to an antenna, and more particularly to a coupling antenna that has a substrate, a first coupling member, a second coupling member and an inducting conductor so that the coupling antenna has a wide bandwidth and a small size.

2. Description of Related Art

Wireless telecommunication technologies have greatly developed to be mature, reliable and marketable so that the market demand for the wireless products greatly increases in the recent years.

With reference to FIG. 1, U.S. Pat. No. 6,081,242 discloses an "antenna matching circuit" that has a printed circuit board (PCB) (24*a*), a connection pad (40), a first inductor (34), a second inductor (38) and a ground plane (42). The PCB (24*a*) has a top surface. The connection pad (40) is mounted on the top surface of the PCB (24*a*). The first inductor (34) is zigzag, is mounted on the PCB (24*a*), is coupled to the connection pad (24*a*) and has an inside end. The second inductor (38) is zigzag, is mounted on the top surface of the PCB (24*a*) and has an inside end. The inside ends of the first and second inductors (34, 38) cooperate to form a capacitor (26*a*). The ground plane (42) is mounted on the top surface of the PCB (24*a*) and is coupled to the second inductor (38). The zigzag first and second inductors (34, 38) improve the inductance effect and the electronic coupling efficiency and reduce the size of the antenna to achieve multi-band operation. However, an area of the antenna generating capacitive coupling effect is small. Therefore, the operating bandwidth of the antenna is narrow so that the practical application of the antenna is limited.

To overcome the shortcomings, the present invention provides a coupling antenna to mitigate or obviate the aforementioned problems.

SUMMARY OF THE INVENTION

The main objective of the invention is to provide a coupling antenna that has a substrate, a first coupling member, a second coupling member and an inducting conductor so that the coupling antenna has a wide bandwidth and a small size.

A coupling antenna has a substrate, an inducting conductor, a ground plane, a first coupling member and a second coupling member. The inducting conductor is mounted on the substrate. The ground plane is formed on and protrudes from the inducting conductor and is mounted on the substrate. The first coupling member is mounted on the substrate and is connected to a feeding cable. The second coupling member is mounted on the substrate and is connected to the first coupling member. The coupling antenna with the first coupling member, the second coupling member and the inducting conductor has a wide bandwidth and a small size.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
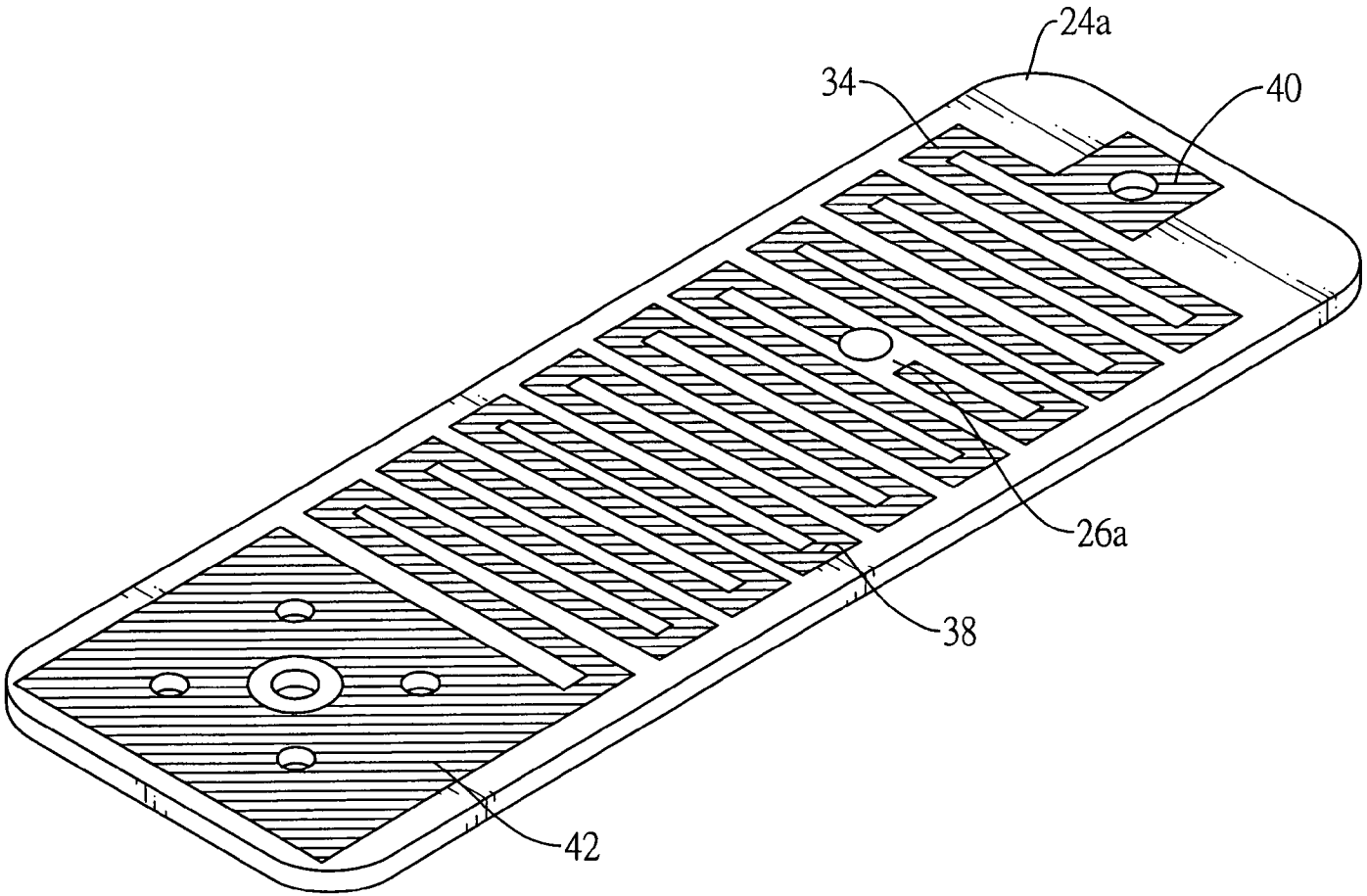
FIG.1 PRIOR ART
FIG. 1 is a perspective view of an antenna matching circuit in accordance with the prior art.
Figure 2:
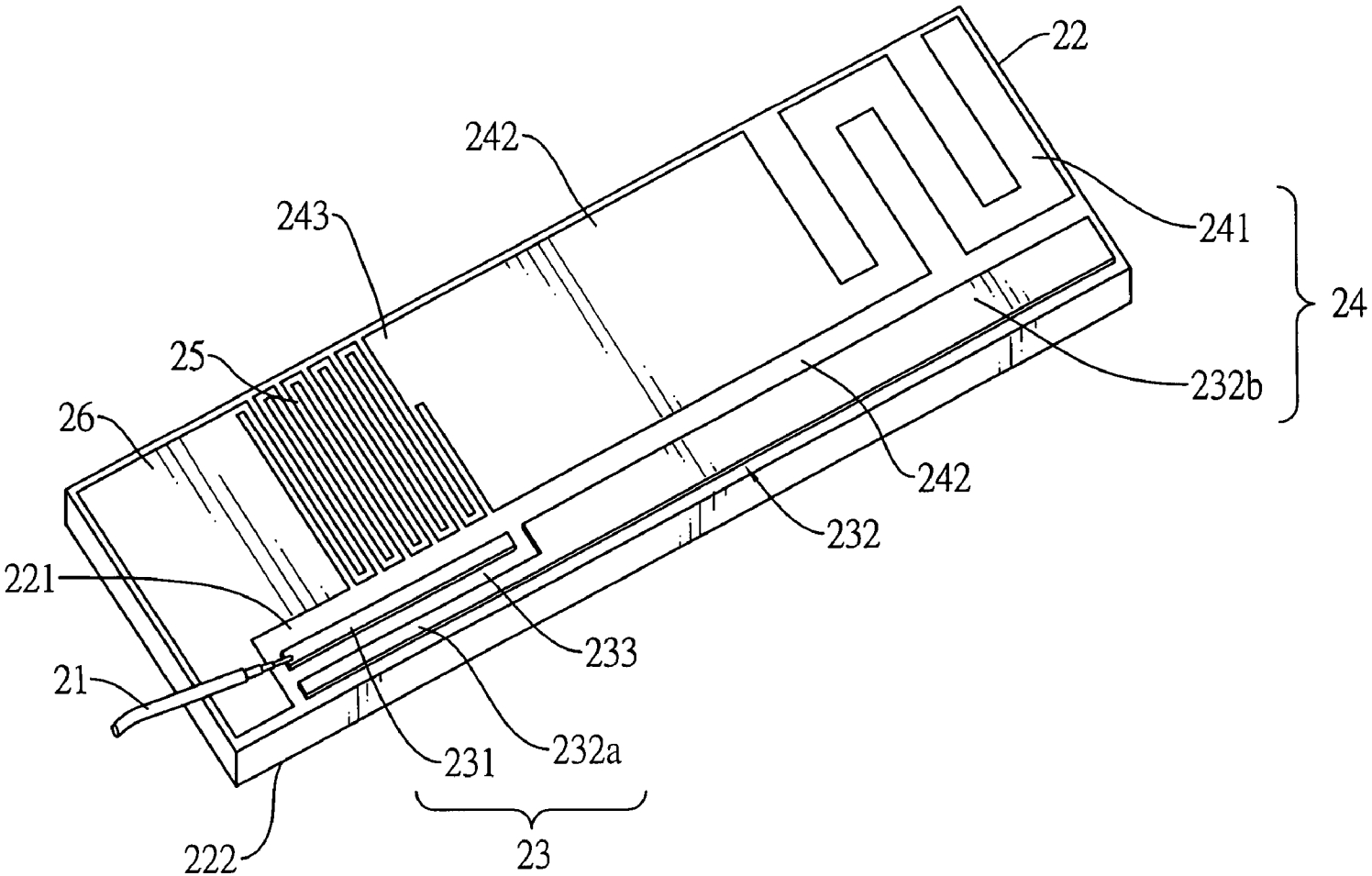
FIG. 2 is a perspective view of a first embodiment of a coupling antenna in accordance with the present invention.
Figure 3:
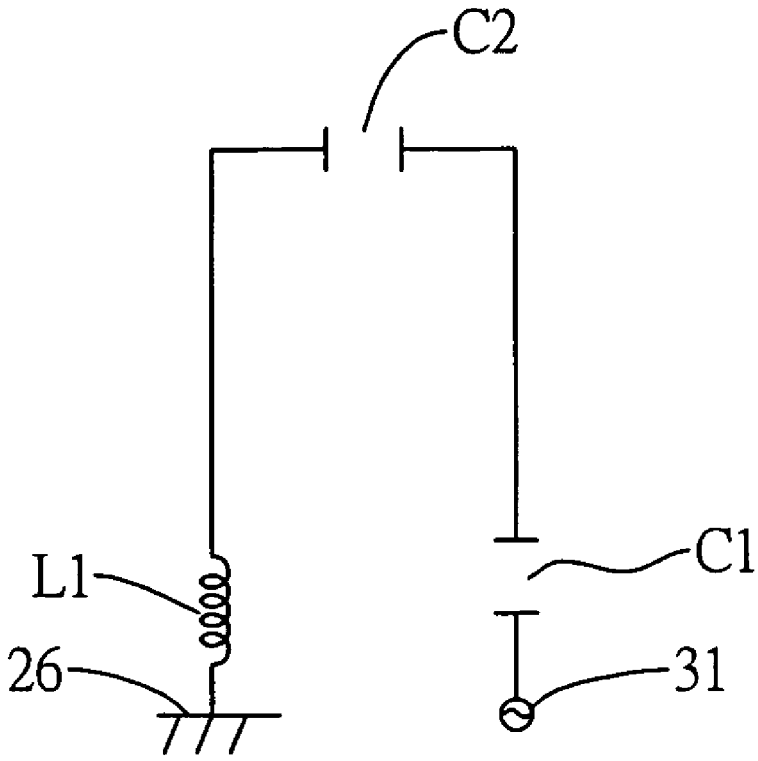
FIG. 3 is a circuit diagram of the coupling antenna in FIG. 1.

With reference to FIGS. 2 and 3, a first embodiment of a coupling antenna in accordance with the present invention is connected to a feeding cable (21) and comprises a substrate (22), a feeding conductor (231), a coupling conductor (232), a mating conductor (241), an extension conductor (242), an inducting conductor (25), a ground plane (26), a first coupling member (23) and a second coupling member (24).

The substrate (22) is made of dielectric material and has a top surface (221) and a bottom surface (222). The dimension of the substrate (22) has the length of about 76 mm, the width of about 9 mm and the thickness of about 0.2 mm.

The feeding conductor (231) is made of metal, is mounted on the top surface of the substrate (22) and is connected to the feeding cable (21) to receive signals from the feeding cable (21). The dimension of the feeding conductor (231) has the length of about 15 mm and the width of about 1 mm.

The coupling conductor (232) is made of metal, is mounted on the top surface (221) of the substrate (22), is separated from the feeding conductor (231) and has a first coupling section (232*a*) and a second coupling second (232*b*).

The first coupling section (232*a*) is mounted on the top surface (221) of the substrate (22) at a longitudinal gap (233) from the feeding conductor (231) and receives the signals from the feeding conductor (231) by a capacitive coupling means. The width of the longitudinal gap (233) is at most 1 mm. The dimension of the first coupling section (232*a*) has the length of about 15 mm and the width of about 1 mm.

The second coupling section (232*b*) is connected to the first coupling section (232*a*), may be formed on and protrude longitudinally from the first coupling section (232*a*) and is mounted on the top surface (221) of the substrate (22). The signals in the coupling conductor (232) are transmitted from the first coupling section (232*a*) to the second coupling section (232*b*). The dimension of the second coupling section (232*b*) has the length of about 55 mm and the width of about 2 mm.

The mating conductor (241) is zigzag, is mounted on the top surface (221) of the substrate (22) near the second coupling section (232*b*) of the coupling conductor (232) at an interval from the second coupling section (232*b*) and receives the signals from the second coupling section (232*b*) by a capacitive coupling means. The mating conductor (241) has a rear end and a front end. The width of the interval is about 0.5 mm. The stretched length of the mating conductor (241) is about 21 mm.

The extension conductor (242) is rectangular, is formed on and protrudes from the front end of the mating conductor (241), is mounted on the top surface (221) of the substrate (22) and has a rear end and a front end (243). The dimension of the extension conductor (242) has the length of about 44 m and the width of about 7 mm.

The inducting conductor (25) is zigzag, is formed on and protrudes from the front end of the extension conductor (242), is mounted on the top surface of the substrate (20) and has a front end and a rear end. The stretched length of the inducting conductor (25) is about 63 mm. The signals from the secondary conductor (242) are transmitted to the inducting conductor through the extension conductor (241).

The ground plane (26) is formed on and protrudes from the front end of the inducting conductor (25), is mounted on the top surface (221) of the substrate (22) and receives the signals from the inducting conductor (25) by inductive effect. The length of the ground plane (26) is about 10 mm.

The first coupling member (23) is defined by the feeding conductor (231), the first coupling section (232*a*) of the coupling conductor (232) and the longitudinal gap (233), serves as a capacitor, is mounted on the substrate (22) and is connected to the feeding cable (21). The longitudinal gap (233) has a sufficient capacitive coupling area so capacitive coupling effect is strong enough to cause the coupling antenna to have a fine impedance variation. Therefore, the first coupling member (23) improves the impedance matching and increases the bandwidth of the coupling antenna when compared to conventional antennas.

The second coupling member (24) is defined by the second coupling section (232*b*), the mating conductor (241) and the interval, serves as a capacitor, is mounted on the substrate (22) and is connected to the first coupling member (23) and the inducting conductor (25). The second coupling member (24) strengthens the capacitive coupling effect and reduces the resonance frequency of the coupling antenna. Therefore, a resonant length of the coupling antenna is reduced to half a wavelength of a central frequency from an operating bandwidth of the coupling antenna to effectively decrease the size of the coupling antenna.

With further reference to FIG. 3 showing a circuit corresponding to the coupling antenna. The circuit is connected to the ground plane (26) and has a signal source (31), a first capacitor (C1), a second capacitor (C2), an inductor (L1).

The first capacitor (C1) corresponding to the first coupling member (23) transmits signals from the signal source (31) to the first coupling section (232*a*) of the coupling conductor (232). The signals are transmitted from the first coupling section (232*a*) to the second coupling section (232*b*). The second capacitor (C2) corresponding to the second coupling member (24) transmits the signals from the second coupling section (232*b*) to the mating conductor (241). The inductor (L1) corresponding to the inductor conductor (25) transmitted the signals from the mating conductor (241) to the ground plane (26). Furthermore, the first capacitor (C1) and the inductor (L1) adjust the impedance matching to increase the bandwidth of the coupling antenna. Moreover, the second capacitor (C2) greatly reduces the resonant length to half the wavelength of the central frequency from the operating bandwidth of the coupling antenna to effectively decrease the size of the coupling antenna.

Figure 4:
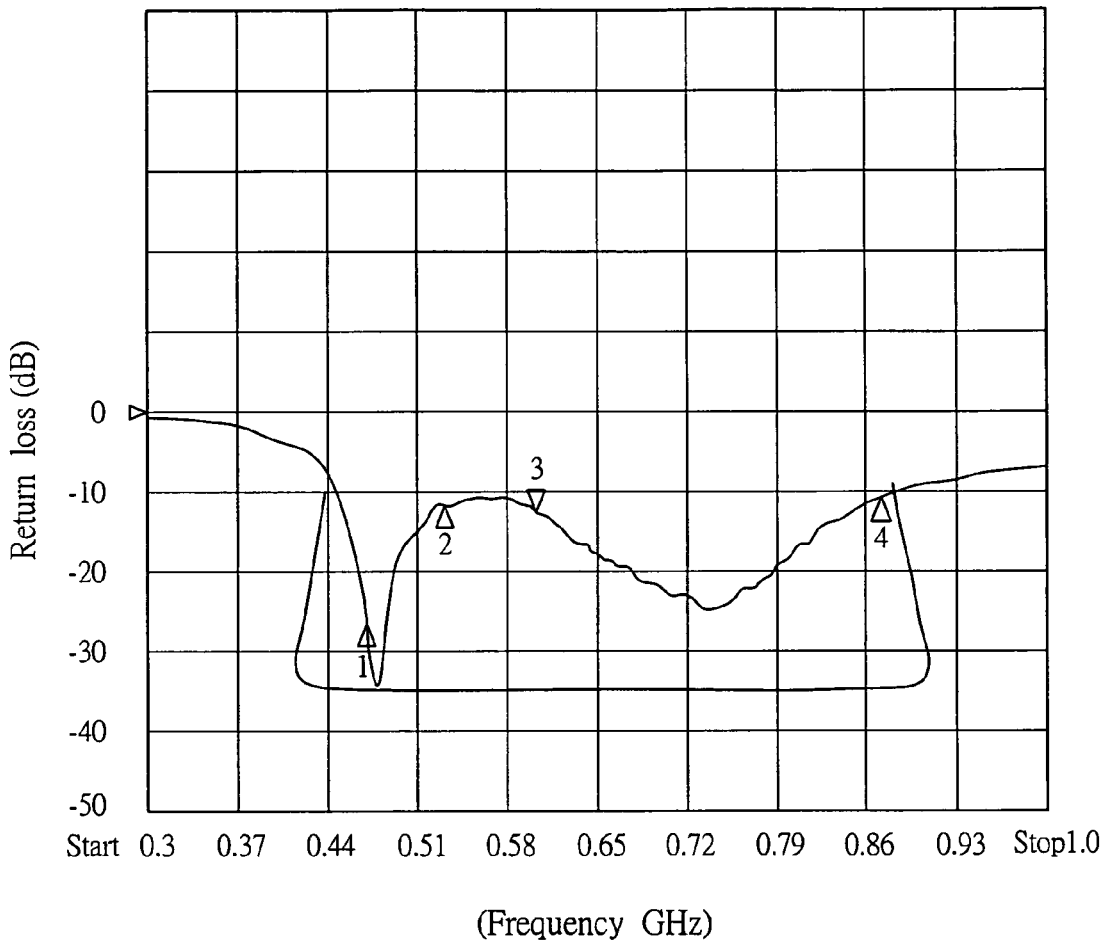
FIG. 4 is a diagram of return loss vs. frequency of the coupling antenna in FIG. 1.

With further reference to FIG. 4 showing a diagram of return loss vs. central frequency of the coupling antenna, the operating bandwidth of the coupling antenna under a voltage standing wave ratio (VSWR) of 2:1 achieves 430 MHz (445-875 MHz), which contains the ultra high frequency (UHF) system bandwidth (470-870 MHz). The operating bandwidth shows that the coupling antenna has low return loss and large bandwidth.

Figure 5:
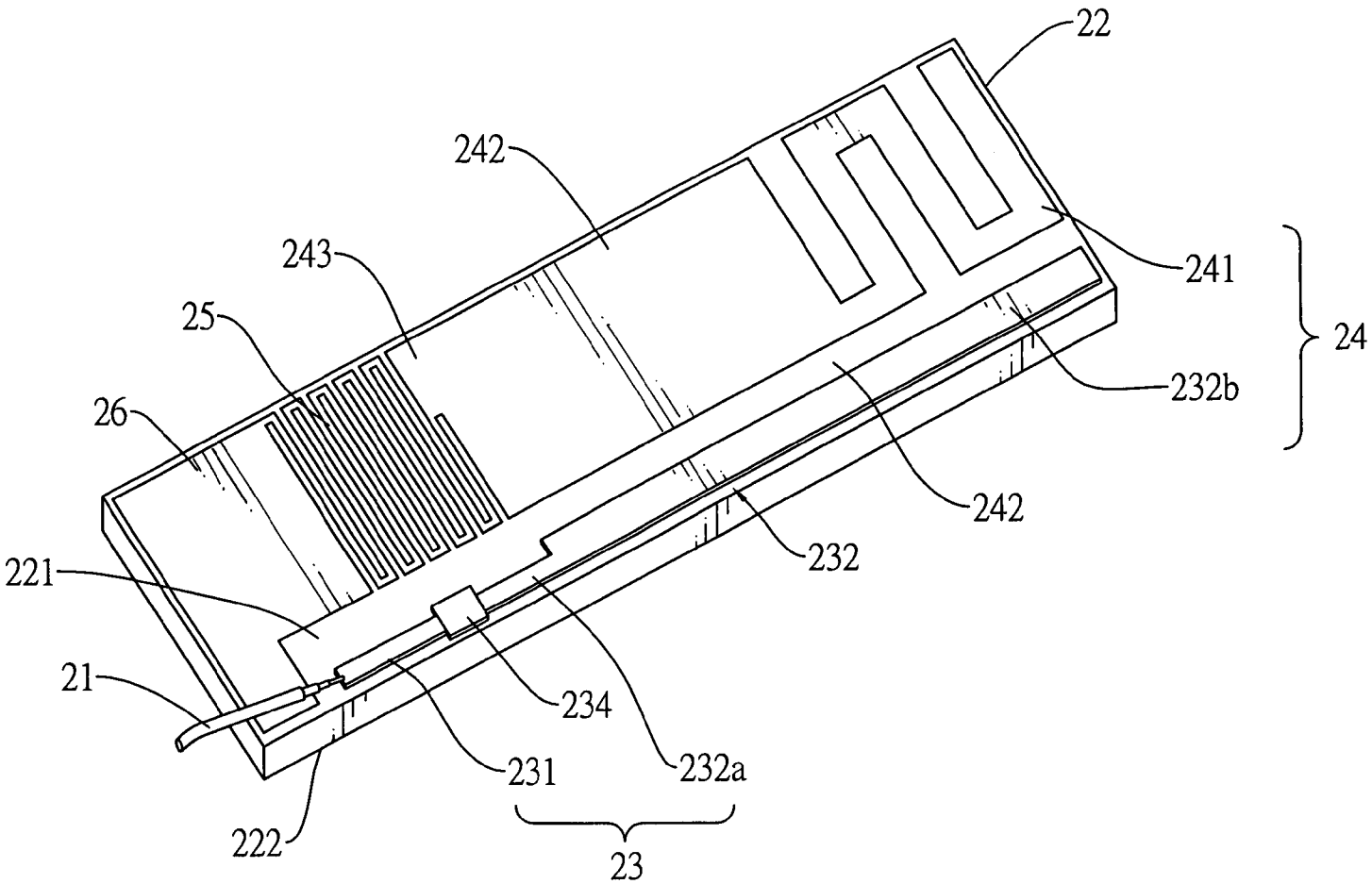
FIG. 5 is a perspective view of a second embodiment of a coupling antenna in accordance with the present invention.

With further reference to FIG. 5, a second embodiment of a coupling antenna in accordance with the present invention is similar to the first embodiment and further has an intermediate capacitor (234). The intermediate capacitor (234) may be a ceramic capacitor, a tantalum capacitor, a porcelain capacitor or the like, is soldered between and connected to the feeding conductor (231) and the first coupling section (232*a*) of the coupling conductor (232). The intermediate capacitor greatly increases the capacitive coupling effect of the first coupling member (23).

Figure 6:
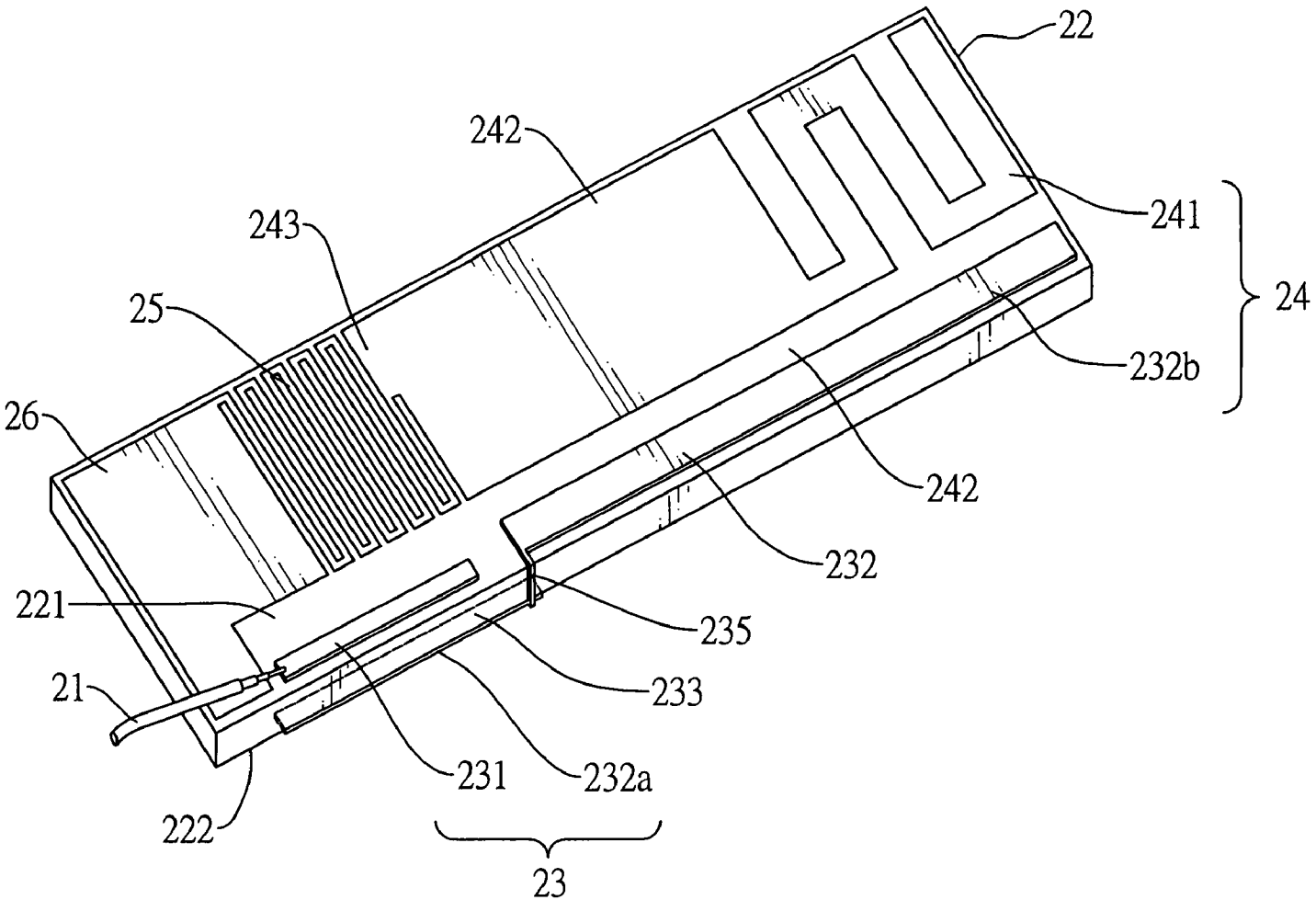
FIG. 6 is a perspective view of a third embodiment of a coupling antenna in accordance with the present invention.

With further reference to FIG. 6, a third embodiment of a coupling antenna in accordance with the present invention is similar to the first embodiment and has the first coupling section (232*a*) of the coupling conductor (232) mounted on the bottom surface (222) of the substrate (22) and further has two ends and a connecting section (235). The connecting section (235) is formed on and protrudes perpendicularly from one end of the first coupling section (232*a*), is connected to the second coupling section (232*b*) and is separated from the feeding conductor (231) to further extend the longitudinal gap (233) into an L-shaped gap. The L-shaped gap increases the capacitive coupling area so that the capacitive coupling effect of the first coupling member (23) is strengthened.

Consequently, the coupling antenna with the first coupling member (23), the second coupling member (24) and the inducting conductor (25) has a wide bandwidth and a small size.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A coupling antenna comprising:

a substrate made of dielectric material;

an inducting conductor mounted on the substrate;

a ground plane formed on and protruding from the inducting conductor and mounted on the substrate;

a first coupling member mounted on the substrate, serving as a capacitor and adapted to be connected to a feeding cable;

a second coupling member mounted on the substrate and connected to the first coupling member, wherein the second coupling member serves as a capacitor;

wherein:

the substrate has a top surface and a bottom surface;

a feeding conductor is mounted on the top surface of the substrate and is adapted to be connected to the feeding cable;

a coupling conductor is mounted on the substrate, is separated from the feeding conductor and has a first coupling section mounted on the substrate at a gap from the feeding conductor; and a second coupling section connected to the first coupling section and mounted on the substrate;

a mating conductor is zigzag, is mounted on the top surface of the substrate near the second coupling section of the coupling conductor at an interval from the second coupling section and has a rear end and a front end;

an extension conductor is rectangular, is formed on and protrudes from the front end of the mating conductor, is mounted on the top surface of the substrate and has a rear end and a front end;

the inducting conductor is zigzag, is formed on and protrudes from the front end of the extension conductor and has a front end and a rear end;

the ground plane is mounted on the top surf ace of the substrate;

the first coupling conductor is defined by the feeding conductor, the first coupling section, of the coupling conductor and the gap; and the second coupling member is defined by the second coupling section, the mating conductor and the interval.

2. The coupling antenna as claimed in claim 1, wherein:

the first coupling section of the coupling conductor is mounted on the top surface of the substrate;

the second coupling section of the coupling conductor is formed on and protrudes longitudinally from the first coupling section; and the gap is a longitudinal gap.

3. The coupling antenna as claimed in claim 2 further having an intermediate capacitor soldered between and connected to the feeding conductor and the first coupling section of the coupling conductor

4. The coupling antenna as claimed in claim 1, wherein:

the first coupling section of the coupling conductor is mounted on the bottom surface of the substrate and further has two ends and a connecting section formed on and protruding perpendicularly from one end of the first coupling section, connected to the second coupling section and separated from the feeding conductor and extending the gap into an L-shaped gap.

* * * * *